United States Patent [19]

Pinson

[11] Patent Number: 5,012,991

[45] Date of Patent: May 7, 1991

[54] PROJECTILE WITH AN OBTURATOR INCORPORATING A MOTOR

[75] Inventor: George T. Pinson, Huntsville, Ala.

[73] Assignee: The Boeing Company, Seattle, Wash.

[21] Appl. No.: 493,821

[22] Filed: Mar. 15, 1990

[51] Int. Cl.[5] ..... F41G 7/32

[52] U.S. Cl. ..... 244/3.12

[58] Field of Search ..... 244/3.12; 89/1.34; 102/504

[56] References Cited

U.S. PATENT DOCUMENTS

| | | | |
|---|---|---|---|
| 3,233,548 | 2/1966 | Chilowsky | 244/3.12 |
| 3,673,963 | 7/1972 | McGowan | 244/3.12 |
| 3,753,537 | 8/1973 | Karpa et al. | 244/3.12 |
| 3,868,883 | 3/1975 | Tucker | 244/3.12 |
| 4,770,370 | 9/1988 | Pinson | 244/3.12 |
| 4,796,833 | 1/1989 | Pinson | 244/3.12 |
| 4,860,968 | 8/1989 | Pinson | 244/3.12 |
| 4,907,763 | 3/1990 | Pinson | 244/3.12 |
| 4,967,980 | 11/1990 | Pinson | 244/3.12 |

FOREIGN PATENT DOCUMENTS

| | | | |
|---|---|---|---|
| 1019184 | 11/1957 | Fed. Rep. of Germany | 244/3.12 |
| 3201019 | 8/1983 | Fed. Rep. of Germany | 244/3.12 |

*Primary Examiner*—Michael J. Carone

*Attorney, Agent, or Firm*—Finnegan, Henderson, Farabow, Garrett & Dunner

[57] ABSTRACT

A tube-launched projectile includes an airframe with an open aft end, an optical fiber dispensing bobbin, and an obturator having a rocket motor attached to a hard point in the aft end of the airframe. The obturator forms a pressure vessel with insulated inner walls which contain rocket propellant and an igniter. An ejectable plug located in the rocket nozzle is expelled upon motor ignition.

10 Claims, 2 Drawing Sheets

PROJECTILE WITH AN OBTURATOR INCORPORATING A MOTOR

BACKGROUND OF THE INVENTION

1. Field of the Invention

The invention relates to a tube-launched projectile with a bobbin for dispensing optical fiber.

2. Description of Related Art

Current tube-launched, optical fiber-guided, self-propelled projectiles rely on relatively complex systems to satisfy the requirements of simultaneous rocket motor propulsion and optical fiber dispensing. For example, U.S. Pat. No. 3,868,883 to Tucker discloses an fiber-optically guided projectile with multiple rocket motor nozzles in the outer peripheral surface of the projectile with optical fiber dispensed from the rear of the projectile. In another example, applicant's copending application Ser. No. 07/451,184, now U.S. Pat. No. 4,974,793 filed Dec. 15, 1989, discloses an optical-fiber dispensing bobbin disposed inside the projectile with a tapered chamber introducing the fiber into the slipstream.

It is desirable for certain applications to have a projectile capable of dispensing optical fiber into the slipstream while also having a simple motor arrangement.

SUMMARY OF THE INVENTION

The advantages of the invention will be set forth in part in the description which follows, and in part will be obvious from the description, or may be learned by practice of the invention. The advantages of the invention will be realized and attained by means of the elements and combinations particularly pointed out in the appended claims.

In accordance with the purpose of the invention, as embodied and broadly described herein, a tube-launched projectile comprises an airframe with an open aft end; an optical fiber dispensing bobbin disposed in the aft end of the airframe; an obturator adjacent to and spaced from the aft end of the airframe, whereby optical fiber dispensed from the bobbin can pass between the airframe and the obturator; and a motor disposed in the obturator.

The invention preferably includes a sting attached to the obturator, passing through the bobbin and attached to a hardpoint in the airframe and a transition fairing extending from the sting to the portion of the obturator adjacent the aft end of the projectile.

It is also preferred that the obturator forms a motor pressure vessel including a motor nozzle, motor propellant and an igniter being contained within the pressure vessel.

It is to be understood that both the foregoing general description and the following detailed description are exemplary and explanatory only and are not restrictive of the invention as claimed.

The accompanying drawings, which are incorporated in and constitute a part of this specification, illustrate an embodiment of the aspects and features of the invention, and together with the description, serve to explain the principles of the invention.

p BRIEF DESCRIPTION OF THE DRAWINGS

FIGS. 3(*a*), 3(*b*), 3(*c*) and 3(*d*) depict the sequential operation of a projectile according to the invention.

Figure 4:
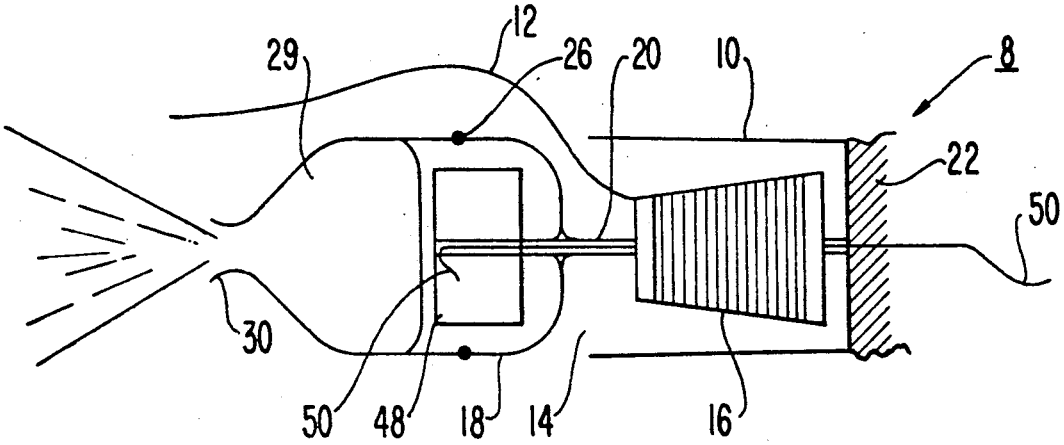
Figure 3A:
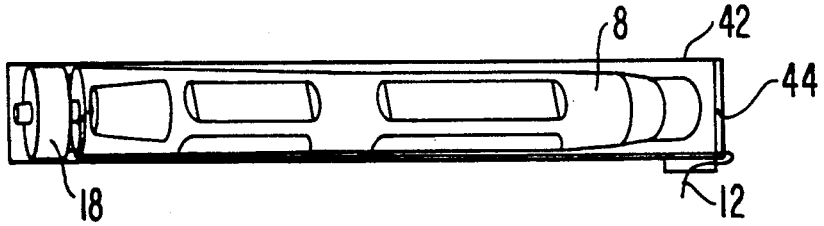
Figure 3B:
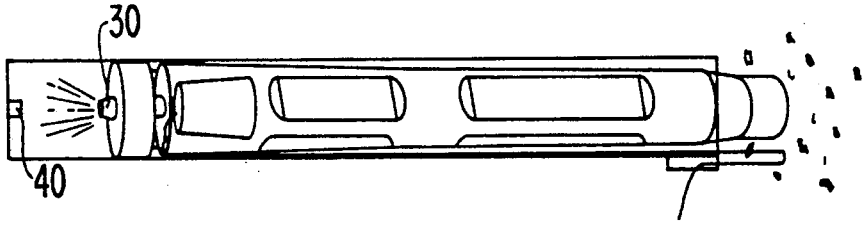
Figure 3C:
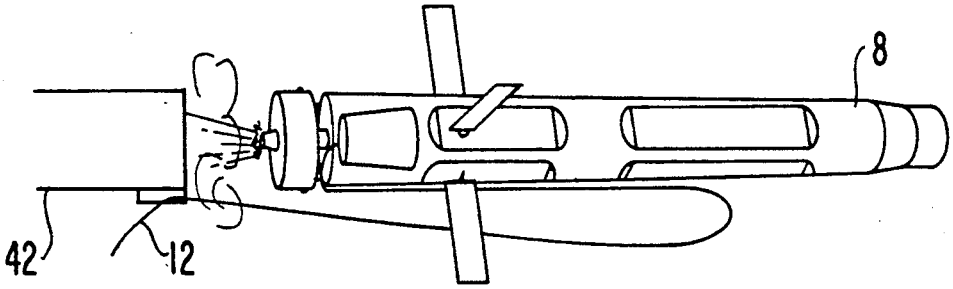
Figure 3D:
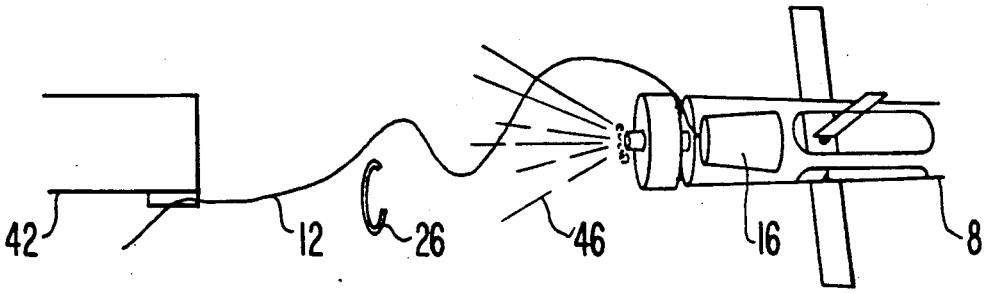

FIG. 4 is a cross-sectional depiction of an alternative embodiment of a projectile according to the invention.

DESCRIPTION OF THE PREFERRED EMBODIMENT

Reference will now be made to the presently preferred embodiments and implementations of the invention, as illustrated in the accompanying drawings. Whenever possible, the same reference numbers will be used throughout the drawings to refer to the same or like parts.

Figure 1:
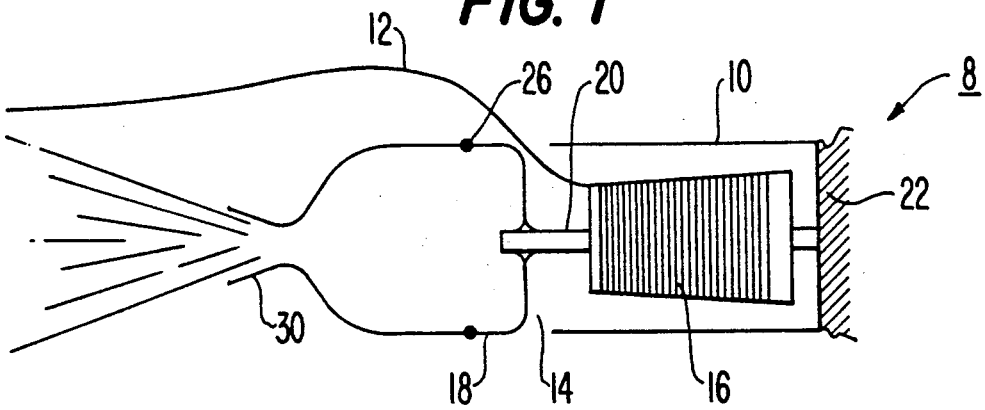
FIG. 1 is a cross-sectional depiction of a projectile according to the invention.

In accordance with the invention, a tube-launched projectile comprises an airframe with an open aft end. As embodied herein and shown in FIG. 1, the airframe 10 houses various projectile components including a warhead and guidance controls (both not shown). The projectile is controlled by signals sent over an optical fiber 12 in the manner disclosed, for example, in the inventor's U.S. Pat. No. 4,770,370. The optical fiber 12 is deployed through the open aft end 14 of the projectile 8.

In accordance with the invention, a tube-launched projectile further comprises an optical fiber-dispensing bobbin disposed within the aft end of the airframe. As embodied herein and shown in FIG. 1, the bobbin 16 holds the optical fiber 12 within the aft end 14 of the airframe 10 until the fiber is pulled from the airframe. The bobbin is preferably wound with optical fiber in a conventional manner. A suitable method for winding a bobbin is disclosed by the inventor's U.S. Pat. No. 4,746,080. The fiber of this invention is sucked into the boundary layer of the hot rocket motor exhaust plume which exists up to 8–10 plume diameters behind the projectile. Therefore, the fiber being released into the gas plume during the period of time that the motor is burning is preferably insulated. However, if the projectile speed is sufficiently great (for example, >500 ft/sec), insulation may not be required. Suitable coatings to protect the fiber are disclosed in the present inventor's commonly assigned U.S. Pat. No. 4,889,400 issued Dec. 26, 1989.

In accordance with the invention, a tube-launched projectile further comprises an obturator adjacent to and spaced from the aft end of the airframe. This spaced relationship allows the optical fiber being dispensed from the bobbin to pass between the airframe and the obturator. As embodied herein and shown in FIG. 1, the obturator 18 is supported by a sting 20 which is attached to the front end of the obturator and passes through the open aft end 14 of the projectile 8 and is attached to a hardpoint or reinforced support 22 within the airframe. The sting should be of a material and size which is of sufficient strength to support thrust from the rocket motor which is aligned with the centerline of the projectile, as discussed below. The sting 20 also passes through the center of the bobbin 16 and provides support and attachment for the bobbin.

In an alternative embodiment shown in FIG. 4, missile components, such as avionics 48, are located within the obturator 18. In this embodiment, wires 50 pass forward through the sting to the main portion of the projectile. Motor 29 is aft of the avionics in this embodiment.

Figure 2:
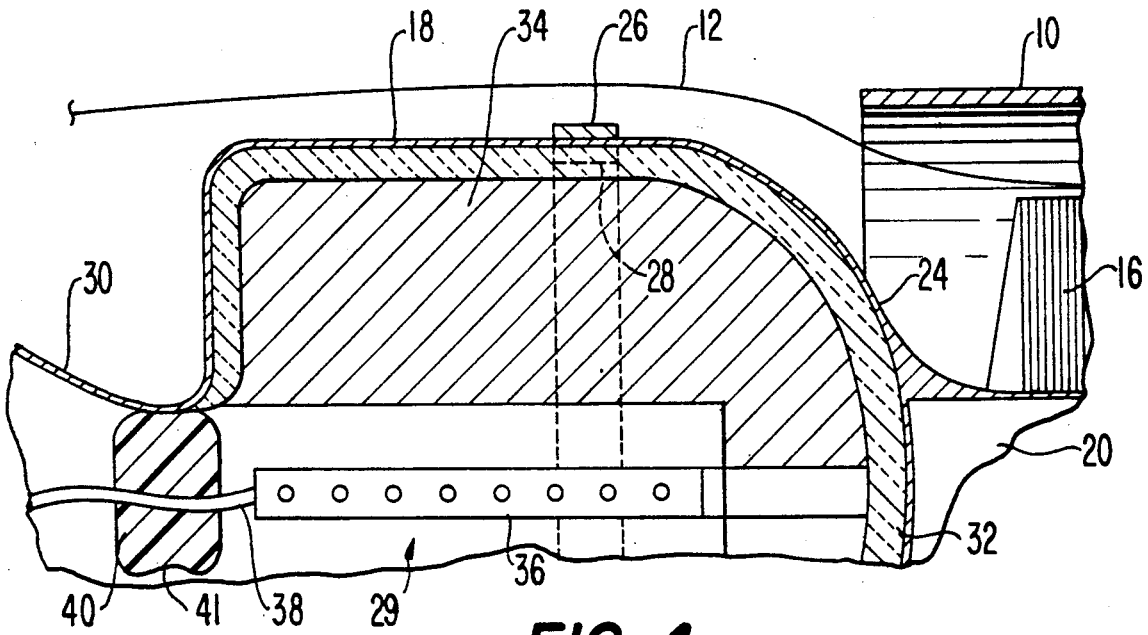
FIG. 2 is a partial cross-sectional depiction of a motor as used in the invention embodied in FIG. 1.

In order to allow the optical fiber being dispensed from the bobbin to pass smoothly from the bobbin into the slipstream, the transition from the sting to the obturator should be smoothly faired, as shown in FIG. 2. The preferable shape of the fairing 24 is the first 180° of a cosine function with the wavelength being greater than or equal to the amplitude.

The obturator serves to seal rocket motor exhaust launch gas into a launch tube (not shown). The obturator body is mainly responsible for this sealing function. However, as shown in FIG. 2, the obturator 18 preferably has on its outer diameter an obturator ring 26 with its outer diameter sized for sliding clearance with the inner diameter of the launch tube. A circumferential groove 28 in the obturator surface receives the ring. Preferably, the obturator body portion rearward of the groove has a reduced diameter compared to the portion forward of groove. Additionally, the circumferential groove preferably has an axially tapered rear-most sidewall, and the ring is preferably constructed of resilient material (e.g., nylon) which in a relaxed state has an inner diameter greater than the diameter of the bottom of groove. The ring is split along a diagonal to facilitate installation into and separation from groove 28. Thus configured, the ring will separate from the obturator when exposed to the slipstream. Additional preferred obturator embodiments can be found in applicant's U.S. Pat. Application Ser. No. 07/493,817, filed concurrently herewith, and assigned to the same assignee.

In accordance with the invention, a tube-launched projectile further comprises a motor disposed in the obturator. As embodied herein and shown in FIG. 2, the obturator 18 is lengthened and forms a pressure vessel for containing the motor 29. Additionally, the aft end of the obturator has a nozzle 30 for expelling the exhaust gas. The interior walls 32 of the pressure vessel are preferably insulated to protect them from the heat of the motor. Furthermore, the vessel contains propellant 34 and an igniter 36 which is ignited by an electrical pulse passed over the igniter wire 38. An ejectable nozzle plug 40 is placed in the nozzle 30 to protect the motor from contaminants. The plug preferably has indented sides 41 which allow it to snap into place. The pressure of the burning exhaust gas ejects the plug once ignition occurs.

In operation, as shown in FIG. 3(*a*), the projectile is placed in a launch tube 42 which may or may not be open at both ends, and the optical fiber 12 exits the front of the tube and is connected to a projectile controller (not shown). The obturator 18 and ring completely seal the tube. Additionally, the top (and end) of the tube may be sealed by a frangible or blow-off cover 44.

After ignition of the motor, the ejectable plug 40 is blown out of the rocket nozzle 30 (FIG. 3(*b*)), the cover is disrupted and the projectile 8 is driven out of the tube (FIG. 3(*c*)). In free flight, as shown in FIG. 3(*d*), the ring 26 is stripped from the obturator 18 by the force of the slipstream, and the fiber 12 is pulled from the bobbin 16 and sucked into the exhaust 46.

It will be apparent to those skilled in the art that various modifications and variations could be made to the invention without departing from the scope or spirit of the invention.

Other embodiments of this invention will be apparent to those skilled in the art from consideration of the specification and practice of the invention disclosed herein. It is intended that the specification and examples be considered as exemplary only, with the true scope and spirit being indicated by the following claims.

What is claimed:

1. A tube-launched projectile comprising:

an airframe with an open aft end;

an optical fiber-dispensing bobbin disposed within said aft end of said airframe;

an obturator adjacent to but spaced from said aft end of said airframe, whereby optical fiber dispensed from said bobbin can pass between said airframe and said obturator; and a motor disposed in said obturator.

2. A projectile as claimed in claim 1 further comprising a sting attached to said obturator, passing through said bobbin and attached to a hardpoint in said airframe, whereby the airframe supports said obturator and said motor.

3. A projectile as claimed in claim 2 further comprising a transition fairing extending from said sting to the portion of said obturator adjacent said aft end of said projectile.

4. A projectile as claimed in claim 3 wherein the fairing has a cross section shaped as the first 180° of a cosine function.

5. A projectile as claimed in claim 4 wherein said cosine function has a wavelength greater than or equal to the amplitude.

6. A projectile as claimed in claim 1 wherein said obturator forms a pressure vessel, and wherein said motor includes propellant and an igniter within said pressure vessel.

7. A projectile as claimed in claim 6 further comprising a nozzle in said pressure vessel.

8. A projectile as claimed in claim 7 further comprising an ejectable plug disposed in said nozzle.

9. A projectile as claimed in claim 2 further comprising at least one missile component located within said obturator forward of said motor.

10. A projectile as claimed in claim 9 wherein at least one wire is located within said sting, said wire running from said missile component forward into said airframe.

* * * * *